US005867756A

United States Patent [19]

Suzuki et al.

[11] Patent Number: 5,867,756

[45] Date of Patent: Feb. 2, 1999

[54] DEVELOPING DEVICE WITH AN AUGER ROLLER FOR PROVIDING A FRESH AND CONSISTENT STREAM OF DEVELOPER IN AN IMAGE FORMING APPARATUS

[75] Inventors: Tsuyoshi Suzuki, Owariasahi; Seiji Shimizu, Ogaki, both of Japan

[73] Assignee: Brother Kogyo Kabushiki Kaisha, Nagoya, Japan

[21] Appl. No.: 862,136

[22] Filed: May 22, 1997

[30] Foreign Application Priority Data

May 27, 1996 [JP] Japan ..... 8-132139
May 28, 1996 [JP] Japan ..... 8-133010

[51] Int. Cl.[6] ..... G03G 15/08

[52] U.S. Cl. ..... 399/255; 399/256; 399/274

[58] Field of Search ..... 399/254, 255, 399/256, 258, 260, 281, 284, 273, 274, 272

[56] References Cited

U.S. PATENT DOCUMENTS 4,760,422 7/1988 Seimiya et al. .
5,338,895 8/1994 Ikegawa et al. ..... 399/280

FOREIGN PATENT DOCUMENTS 61-77877 4/1986 Japan .
8-50405 2/1996 Japan .

*Primary Examiner*—Joan H. Pendegrass
*Attorney, Agent, or Firm*—Oliff & Berridge, PLC

[57] ABSTRACT

A developing device for use in an image forming apparatus is constructed such that a pair of upper and lower auger rollers 35 and 34 are arranged in the vicinity of a toner supply port 21A, thereby to transport toner from the toner supply port 21A through a spiral tooth 34A of the lower auger roller 34 toward both ends of the supply roller 20 and from the both ends through a spiral tooth 35A toward the toner supply port 21A, thus circulating toner above the toner supply roller 20 in its both side directions, and that a position of the toner supply port 21A of a toner cartridge 21 corresponds to respective center positions 35C and 34C of the upper and lower auger rollers 35 and 34.

10 Claims, 10 Drawing Sheets

PRIOR ART

PRIOR ART

DEVELOPING DEVICE WITH AN AUGER ROLLER FOR PROVIDING A FRESH AND CONSISTENT STREAM OF DEVELOPER IN AN IMAGE FORMING APPARATUS

BACKGROUND OF THE INVENTION

1. Field of the Invention

The present invention relates to a developing device for use in an image forming apparatus such as a laser printer, etc., for developing an electrostatic latent image by supplying toner to the electrostatic latent image formed on an outer peripheral surface of a photosensitive drum and transferring the image developed on the surface of the photosensitive drum onto a sheet, and particularly to a developing device in an image forming apparatus capable of supplying toner which is supplied through a toner supply port formed in the developing device on a supply roller so that constantly fresh toner may be stuck uniformly on all over the supply roller, thereby capable of forming the image excellent in quality, for a long period.

In addition, the present invention relates to a developing device for use in an image forming apparatus such as a laser printer, etc., for developing an electrostatic latent image by supplying toner to the electrostatic latent image formed on an outer peripheral surface of a photosensitive drum and transferring the image developed on the surface of the photosensitive drum onto a sheet, and particularly to a developing device for use in an image forming apparatus, capable of smoothly supplying toner supplied from a toner storing part through a toner supply roller to a developing roller without causing toner clogging of a toner supply path formed around the toner supply roller and the developing roller, thus for a long time obtaining the resultant image excellent in quality.

2. Description of Related Art

Regarding conventional developing devices for use in image forming apparatuses such as laser printers, etc., there have been proposed various types of the devices, wherein the developing devices are often constructed in a unit type to be attachably mounted in a laser printer. Such a developing device is usually provided with an exchangeable toner cartridge for storing therein toner, and a toner supply port constructed of an opening for toner supply formed at a substantially center position of the toner cartridge in its width direction and another opening for toner supply formed in a frame of the developing device, through which toner is supplied.

One embodiment of the developing device will be explained with reference to FIG. 10. FIG. 10 is an explanatory view showing schematically a main construction of the developing device in the prior art.

In FIG. 10, the developing device has a toner cartridge 100 which accommodates therein toner and is provided with an opening for toner supply at an almost center in its width direction. This toner cartridge 100 is provided therein with an agitator 103 for agitating toner to supply same into a developing chamber 102 side through a toner supply port 101. A frame F of the developing device is provided with an opening for toner supply positioned corresponding to the toner supply opening of the toner cartridge 100. Those openings of the toner cartridge 100 and the frame F form the toner supply port 101 in combination with each other.

Inside the developing chamber 102 defined by an upper frame F1 and a lower frame F2 of the frame F, a toner supply roller 104 is arranged rotatably in a lower frame F2 side, for supplying the toner supplied through the toner supply port 101 to a developing roller 105. On an internal wall of the upper frame F1, above the developing roller 105, a blade 107 is fixedly secured with a fixing element 106, whereby to regulate a thickness of toner layer formed on the surface of the developing roller 105. This developing roller 105 is also arranged in contact with a photosensitive drum 108. On the peripheral surface of the photosensitive drum 108 is formed an electrostatic latent image by an image exposure device not shown which performs a scanning operation with a laser beam in accordance with image data. The developing roller 105 supplies toner on the electrostatic latent image formed on the peripheral surface of the photosensitive drum 108 to develop the image. The image developed on the surface of the photosensitive drum 108 is then transferred onto a sheet fed from a sheet feeder not shown, forming a resultant image, i.e., a visual image on the sheet.

In the toner cartridge 100 of conventional developing device mentioned above, however, toner would drop from and scatter outside the toner cartridge 100, for instance, in exchanging the toner cartridge 100. Such the toner scattering may cause toner sticking on other components of the laser printer and thus contamination of those components. To prevent the toner scattering, the conventional toner cartridge 100 is generally provided with only one toner supply port 101 at an almost center position in the width direction of the toner cartridge 100, i.e., in a vertical direction with respect to the drawing paper of FIG. 10, also corresponding to the width direction of the laser printer.

Accordingly, during a toner supplying operation to supply toner from the toner cartridge 100 to the developing chamber 102 through the toner supply port 101, the toner often tends to remain in the center portion of the toner supply roller 104. This causes a shortage of toner to be supplied to both side portions of the toner supply roller 104. In this case, it is impossible to supply toner uniformly to all over the toner supply roller 104, resulting in uneven toner supply with respect to the developing roller 105 and thus the electrostatic latent image formed on the photosensitive drum 108. As a result, the resultant image on the sheet would uneven in density, namely, dark in a center part on the sheet and pale in both side parts on the same, thereby causing a problem of a deterioration in image quality.

Furthermore, to solve the aforesaid problem that unevenness in the image density occurs due to ununiform supplying and sticking of toner onto all over the toner supply roller 104 in the toner cartridge 100 of the conventional developing device mentioned above, there may be provided an auger roller 109 (FIG. 11), for example, which is arranged rotatably above the toner supply roller 104, for circulating the toner supplied from the toner supply port 101 in a predetermined direction. With this auger roller 109, toner can be transported and circulated above the toner supply roller 104 inside the developing chamber 102, thereby enabling uniform supplying and sticking of toner to the toner supply roller 104.

However, there may occur a problem that such the auger roller 109 disposed above the supply roller 104 blocks a smooth flow of toner along the toner supply path formed around the toner supply roller 104 and the developing roller 105, thus causing the toner supply path to be clogged with the toner. If a toner clogging in the toner supply path occurs in such a way, it prevents appropriate supply of toner from the toner supply roller 104 to the developing roller 105, which would cause an extreme deterioration in quality of the resulting image obtained by developing the electrostatic latent image formed on the photosensitive drum 108. It is therefore difficult to continuously form the image excellent in quality.

SUMMARY OF THE INVENTION

The present invention has been made in view of the above circumstances and has an object to overcome the above problems and to provide a developing device for use in an image forming apparatus capable of supplying and sticking constantly fresh toner uniformly over a supply roller when sticking the toner supplied from a toner supply port formed in the developing device onto the supply roller, thus enabling to form for a long time the resulting image excellent in quality.

Another object of the present invention is providing a developing device for use in an image forming apparatus capable of providing a good flow of toner and thereby smoothly supplying toner from a supply roller to a developing roller without causing toner clogging in a toner supply path formed around the toner supply roller and the developing roller when the toner discharged from a toner supply port formed in the developing device is supplied to the developing roller through the toner supply roller, thereby enabling to form the resulting image excellent in quality, for a long period.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a developing device of this invention for use in an image forming apparatus for performing image formation through an electrophotographic process, comprising a developing roller arranged opposite to a photosensitive drum, for supplying toner to an electrostatic latent image formed on the photosensitive drum thereby to develop the image, a supply roller arranged opposite to the developing roller and for supplying toner to the developing roller, the device comprises a toner supply port through which toner is supplied to a developing chamber provided therein with said developing roller and said supply roller, and a pair of first and second auger members arranged in the vicinity of said toner supply port, for transporting and circulating toner from the toner supply port and supplying the toner to the supply roller.

According to the above developing device of the present invention, toner is discharged from the toner supply port in the developing chamber and stuck on the supply roller when an image forming operation is performed in the image forming apparatus. At this time, a pair of first and second auger members are arranged in the vicinity of the toner supply port, thereby to transport and circulate the toner above the supply roller via the first and second auger members. This allows the toner, while circulating, to supply uniformly on all over the supply roller. In this way, the toner stuck on the supply roller is supplied to the developing roller and, then, the developing roller supplies the toner to the electrostatic latent image formed on the outer peripheral surface of the photosensitive drum, performing a toner development on the electrostatic latent image. After that, the developed image on the photosensitive drum is transferred to a sheet, forming the resulting image on the sheet.

In the developing device according to the present invention, preferably, the toner supply port is formed at a center position of the developing chamber, the first auger member transports toner from a position corresponding to the toner supply port toward both ends of the supply roller and the second auger member transports toner from the both ends toward the center position corresponding to the toner supply port.

In the developing device according to the present invention, preferably, the first auger member is provided with a spiral tooth extending from a center position of the first auger member toward both ends thereof, and the second auger member is provided with a spiral tooth extending from both ends of the second auger member toward a center position thereof.

Furthermore, in the developing device according to the present invention, preferably, a position where the toner supply port is formed corresponds substantially to each center position of the first and second auger members, and the first auger member is disposed at a lower position than the second auger member.

According to the above developing device of the present invention, a pair of first and second auger members are arranged in the vicinity of the toner supply port thereby to transport and circulate toner through the first and second auger members, so that constantly fresh toner can be allowed to uniformly supply on all over the supply roller, thus the toner be supplied uniformly to the developing roller and the outer peripheral surface of the photosensitive drum. This makes it possible to form for a long time a resultant image (a visual image) excellent in quality.

In another aspect of the present invention, there is provided a developing device for use in an image forming apparatus for performing image formation through an electrophotographic process, comprising a developing roller arranged opposite to a photosensitive drum, for supplying toner to an electrostatic latent image formed on the photosensitive drum thereby to develop the image, a supply roller arranged opposite to the developing roller and for supplying toner to the developing roller, an L-shaped blade member provided with a contact portion being in contact with a surface of the developing roller and an extruding portion formed extruding outward from the contact portion, for regulating a thickness of a toner layer on the developing roller, the device comprising a toner supply port through which toner is supplied to a developing chamber provided therein with said developing roller, said supply roller, and the blade member, and an auger member disposed in the vicinity of said toner supply port, for transporting and circulating toner from the toner supply port and supplying the toner to the supply roller, wherein a first gap formed between the extruding portion of the blade member and an outer peripheral surface of the auger member and a second gap formed between an outer peripheral surface of the supply roller and the outer peripheral surface of the auger member are determined to 0.5 mm or more.

In the developing device for use in an image forming apparatus according to the present invention, preferably, the first and second gaps are determined to 1.0 mm or more.

In the developing device for use in an image forming apparatus according to the present invention, preferably, the toner supply port is formed at a center position of the developing chamber, the auger member transports toner from a position corresponding to the toner supply port toward both ends of the supply roller.

In the developing device for use in an image forming apparatus according to the present invention, preferably, the auger member is provided with a spiral tooth extending from a center position of the auger member toward both ends thereof.

According to the above developing device of the present invention, an auger member for transporting and circulating toner from the toner supply port to supply same on the supply roller is arranged in the vicinity of the toner supply port formed in the developing chamber and, in the toner supply path formed around the supply roller and the developing roller, the first gap formed between the extruding portion of the L-shaped blade member and the outer peripheral surface of the auger member and the second gap formed between the outer peripheral surface of the supply roller and the outer peripheral surface of the auger member are both determined to 0.5 mm or more, so that a flow of toner can be made smooth in the toner supply path in the developing chamber even if an auger member is provided therein without causing a toner clogging in the toner supply path. It is accordingly to supply smoothly toner from the supply roller to the developing roller, enabling to form for along period the resultant image excellent in quality.

In further aspect of the present invention, there is provided a developing device for use in an image forming apparatus for performing image formation through an electrophotographic process, comprising a developing roller arranged opposite to a photosensitive drum, for supplying toner to an electrostatic latent image formed on the photosensitive drum thereby to develop the image, a supply roller arranged opposite to the developing roller and for supplying toner to the developing roller, an L-shaped blade member provided with a contact portion being in contact with a surface of the developing roller and an extruding portion formed extruding outward from the contact portion, for regulating a thickness of a toner layer on the developing roller, the device comprising a toner supply port and a toner suction port respectively formed in both sides of a developing chamber provided therein with the developing roller, the supply roller, and the blade member, and an auger member disposed in the vicinity of the toner supply port and the toner suction port, for transporting and circulating toner from the toner supply port toward the toner suction port and supplying the toner to the supply roller, wherein a first gap formed between the extruding portion of the blade member and an outer peripheral surface of the auger member and a second gap formed between an outer peripheral surface of the supply roller and the outer peripheral surface of the auger member are determined to 0.5 mm or more.

In the developing device for use in an image forming apparatus according to the present invention, preferably, the auger member is provided with a spiral tooth extending from one end of the auger member to another.

In the developing device for use in an image forming apparatus according to the present invention, preferably, the developing roller, the supply roller, and the auger member are driven to rotate in the same rotating direction.

According to the above developing device of the present invention, furthermore, an auger member for transporting and circulating toner from the toner supply port to supply same on the supply roller is arranged in the vicinity of the toner supply port and the toner suction port each formed in the toner storing part and, in the toner supply path formed around the supply roller and the developing roller, the first gap formed between the extruding portion of the L-shaped blade member and the outer peripheral surface of the auger member and the second gap formed between the outer peripheral surface of the supply roller and the outer peripheral surface of the auger member are both determined to 0.5 mm or more, so that a flow of toner can be made smooth in the toner supply path in the developing chamber even if an auger member is provided therein without causing a toner clogging in the toner supply path. It is accordingly to supply smoothly toner from the supply roller to the developing roller, enabling to form for along period the resultant image excellent in quality.

In still further aspect of the present invention, there is provided a developing device for use in an image forming apparatus for performing image formation through an electrophotographic process, comprising a developing roller arranged opposite to a photosensitive drum, for supplying toner to an electrostatic latent image formed on the photosensitive drum thereby to develop the image, a supply roller arranged opposite to the developing roller and for supplying toner to the developing roller, an L-shaped blade member provided with a contact portion being in contact with a surface of the developing roller and an extruding portion formed extruding outward from the contact portion, for regulating a thickness of a toner layer on the developing roller, the device comprising a toner supply port through which toner is supplied to a developing chamber provided therein with the developing roller, the supply roller, and the blade member, and an auger member disposed in the vicinity of the toner supply port, for transporting and circulating toner from the toner supply port and supplying the toner to the supply roller, wherein at least one of a first gap formed between the extruding portion of the blade member and an outer peripheral surface of the auger member and a second gap formed between an outer peripheral surface of the supply roller and the outer peripheral surface of the auger member is determined to 1.0 mm or more.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENTS

A detailed description of preferred embodiments of a developing device for use in an image forming apparatus, specifically in a laser printer, embodying the present invention will now be given referring to the accompanying drawings.

Figure 1:
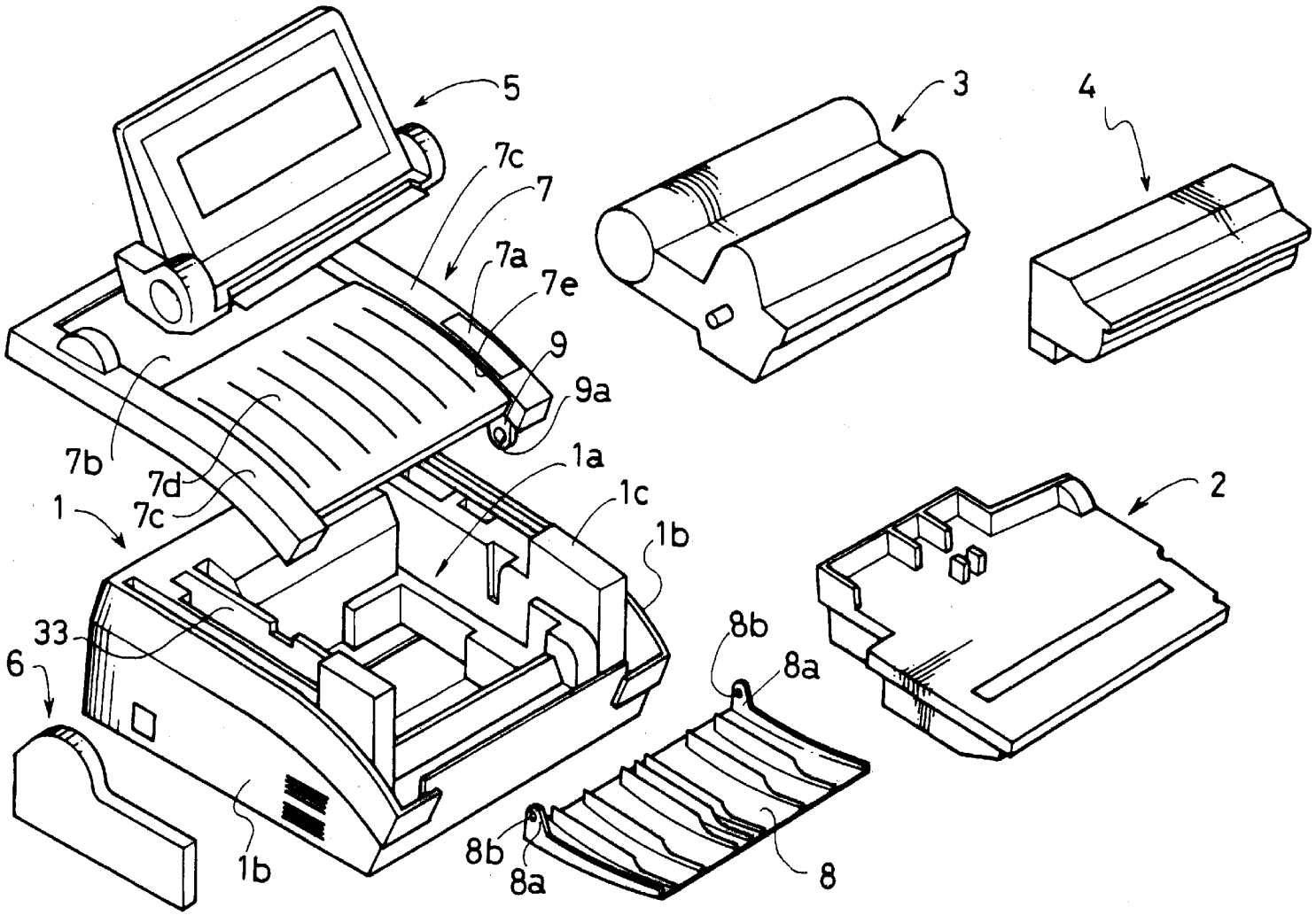
FIG. 1 is a perspective exploded view of main components of a laser printer in a first embodiment according to the present invention.
Figure 2:
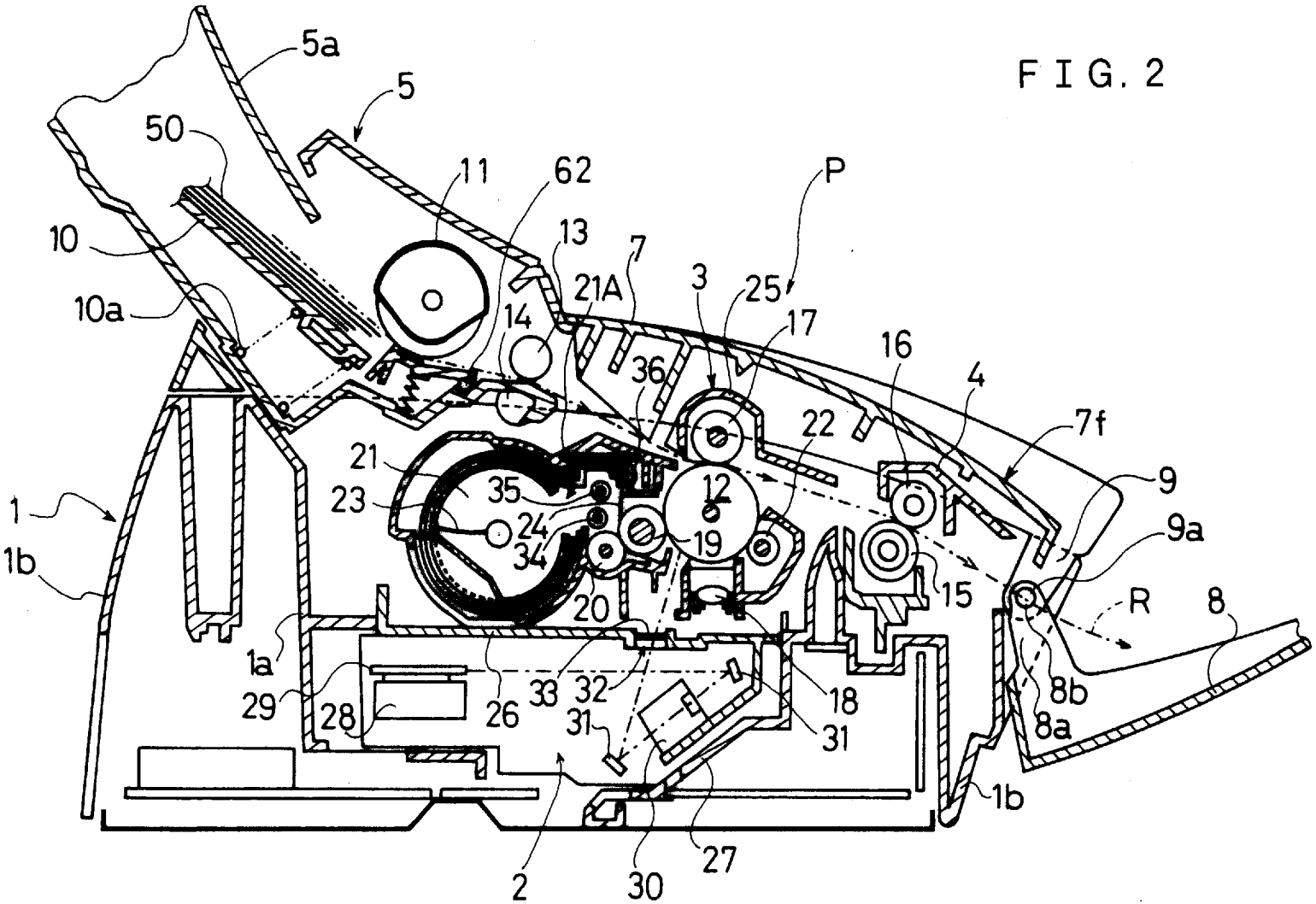
FIG. 2 is a sectional side view of the laser printer of FIG. 1.

First, schematic construction of a laser printer P in a first embodiment will be described with reference to FIGS. 1 and 2. FIG. 1 is a perspective exploded view of a main construction of the laser printer P. FIG. 2 is a sectional side view of the laser printer P.

In FIG. 1, a main housing 1 of the laser printer P is formed integrally of a main frame 1*a* and a main cover 1*b* by, for example, an injection molding process. In the main unit 1*a*, set are a scanner unit 2, a process unit 3, a fixing unit 4, and a sheet supply unit 5 from above the main unit 1*a*. The main cover 1*b* serves to cover the outer peripheral four side surfaces, i.e., a front, back, right, and left sides, of the main frame 1*a*. In a holding recess 33 defined the outer surface of the main frame 1*a* and inner surface of the main cover 1*b*, a driving system unit 6 including a driving motor and a train of gears is installed and fixed from the lower side of the main housing 1.

The main frame 1*a* is provided with an operational panel 1*c* formed extruding upward. Both upper surfaces of the main frame 1*a* and the main cover 1*b* are covered with an upper cover 7. This upper cover 7 is provided with a hole 7*a* through which the operational panel 1*c* can be inserted and an opening 7*b* through which a base part of the sheet supply unit 5 can be inserted. At both sides in a front side of the upper cover 7 (a right side in FIG. 1), a pair of brackets 9 each having a support shaft 9*a* extruding opposite to each other (only one of them is shown in FIG. 1). A sheet discharge tray 8 is provided with support portions 8*a* formed at both sides thereof and bores 8*b* formed in the support portions 8*a*. Each of the bores 8*b* can be fitted with each support shaft 9*a* of the brackets 9 so that the sheet discharge tray 8 is supported rotatably with respect to the upper cover 7. On the upper surface of the upper cover 7, there are provided step portions 7*e* between the upper surfaces of side parts 7*c* and the upper surface of a center part 7*d*. Such the step portions 7*e* form a holding recess 7*f* as shown in FIG. 2 for holding the sheet discharge tray 8 in the center part 7*d* of the upper cover 7 during non-use of the tray 8. The sheet discharge tray 8 in non-use can be held in the holding recess 7*f* by turning about the support portions 8*a* to a position where it is held in the upper cover 7 side and, to the contrary, it can be set for use at a position to stack sheets discharged from the fixing unit 4 by turning contrariwise from the holding position to a stack position shown in FIG. 2.

Next, the schematic internal structure of the laser printer P will more detail be explained referring to FIG. 2. In FIG. 2, sheets 50 are held as stacked in a feeder case 5*a* of the sheet supply unit 5. The tip end of each sheet 50 is pressed against a sheet supply roller 11 by a support plate 10 provided with a biasing spring 10*a*, disposed inside the feeder case 5*a*. The sheet supply roller 11 is driven to rotate by a driving power transmitted from the driving system unit 6 and transport individual sheets from the feeder case 5*a* in cooperation with a sheet separating member 62. The sheet 50 separated from the overlaid sheet stack is transported to the process unit 3 by means of a pair of resist rollers 13 and 14.

The process unit 3 is a unit to perform a toner development of electrostatic latent image by supplying toner to the electrostatic latent image formed on the peripheral surface of the photosensitive drum 12 by means of a laser optical system which will be mentioned later, provided in the scanner unit 2 in accordance with image data. More specifically, the process unit 3 is constructed of the photosensitive drum 12, a transfer roller 17 disposed above the photosensitive drum 12 and in contact therewith, a charger 18 such as a Scorotron type of charger, disposed under the photosensitive drum 12, a developing unit including a developing roller 19 disposed upstream of the photosensitive drum 12 in a sheet feeding direction and a toner supply roller 20, a toner cartridge 21 attachably and detachably disposed upstream of the developing unit, which serves as a toner storing unit, and a cleaning roller 22 disposed downstream of the photosensitive drum 12, and other components.

Inside of the developing chamber of the developing unit, a pair of auger rollers, namely, a lower auger roller 34 and an upper auger roller 35, are rotatably provided above the toner supply roller 20. This lower auger roller 34 functions to transport the toner that is supplied from the toner cartridge 21 via a toner supply port 21A into the developing chamber, toward both sides of the toner supply roller 20 above the toner supply roller 20. The toner supply port 21A is constructed of an opening formed in the toner cartridge at an almost center position thereof and an opening formed in a unit frame 25. The upper auger roller 35 functions to transport the toner from the both sides of the toner supply roller 20 toward the toner supply port 21A. In this way, the toner is supplied from the toner supply port 21A to the developing chamber side by means of the upper and lower auger rollers 35 and 34, thereby to circulate above the toner supply roller 20 in the both sides thereof. While circulating, the toner is supplied to and stuck on the toner supply roller 20. The detail structure of each of the lower auger roller 34 and the upper auger roller 35 will be described later.

Above the developing roller 19, a blade 24 is secured with an L-shaped blade fixing element 36 on the lower surface of the unit frame 25. The blade 24 serves to regulate the thickness of a layer of toner supplied on the developing roller 19 from the toner supply roller 20 into a predetermined thickness.

Figure 3:
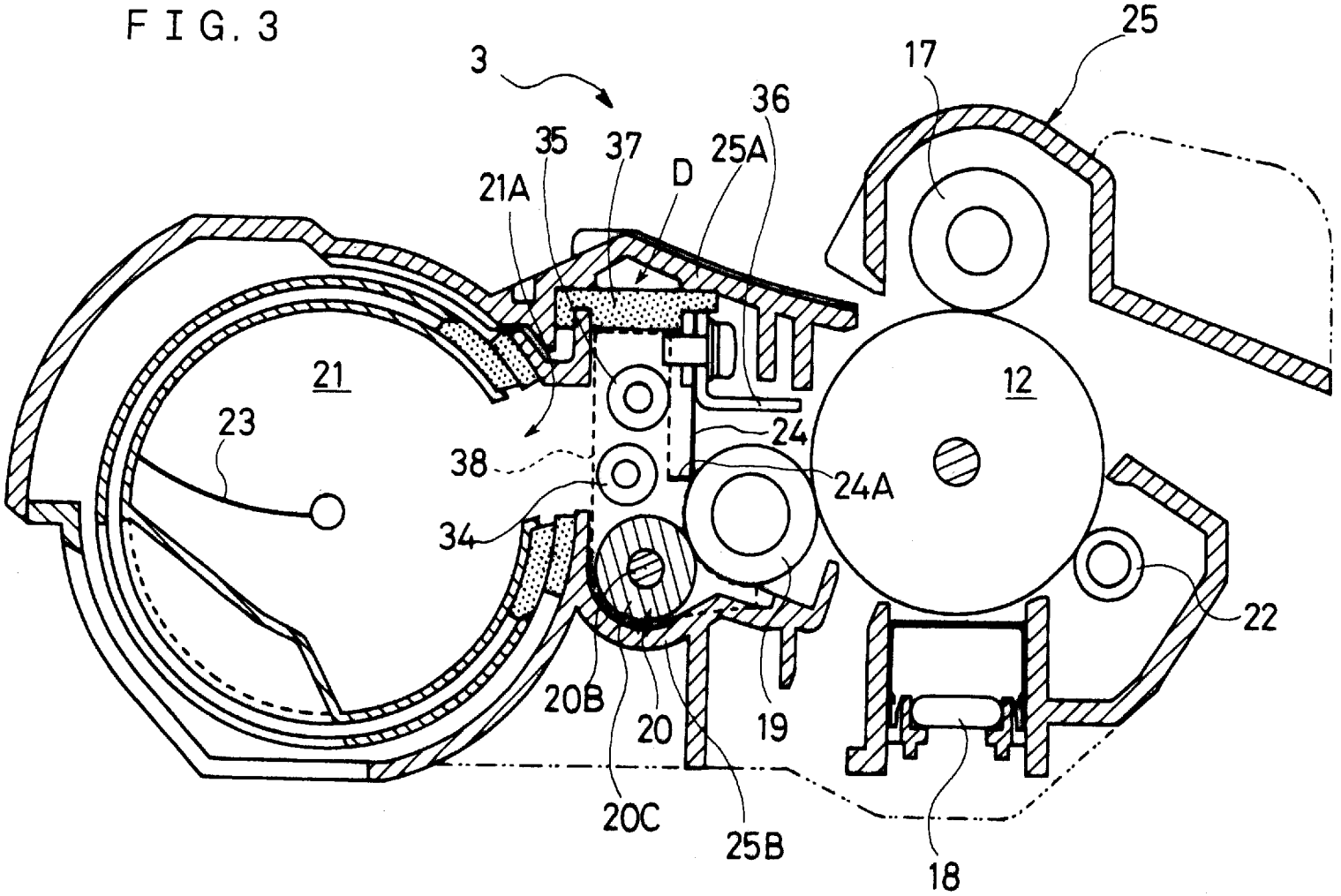
FIG. 3 is a sectional side view of a process unit of the laser printer of FIG. 1.

The blade 24 is also provided with a protruding portion 24A formed protruding outward from the contact portion of the blade 24 with the developing roller 19 as shown in FIG. 3, thus forming the blade 24 in an L-shape.

On the outer peripheral surface of the photosensitive drum 12, an electrically charged layer is formed by the charger 18 and, then, an electrostatic latent image is formed thereon by scanning with a laser beam by means of the scanner unit 2. The toner stored in the toner cartridge 21 is stirred by an agitator 23 thereby to discharge the toner through the toner supply port 21A toward the developing chamber, then is carried via the toner supply roller 20 on the outer peripheral surface of the developing roller 19, where the attracted toner is regulated to form a layer of toner having a predetermined thickness by means of the blade 24. When the toner is transported from the developing roller 19 to and stuck on the photosensitive drum 12, the electrostatic latent image formed on the photosensitive drum 12 is visualized and transferred to the sheet 50 passing between the transfer roller 17 and the photosensitive drum 12. The residual toner remaining on the photosensitive drum 12 is transported to the cleaning roller 22 and, after a predetermined time, is returned to the photosensitive drum 12 and collected back to the developing chamber via the developing roller 19.

The process unit 3 constructed above is made as a cartridge type by assembling all components into the unit frame 25 formed of synthetic resin. This cartridge-type process unit 3 is detachably and attachably mounted in the main frame 1*a*.

The scanner unit 2 is provided with a well known laser optical system and makes a scanning on the photosensitive drum 12 by the laser optical system in accordance with a predetermined image data, thereby forming an electrostatic latent image on the photosensitive drum 12. More specifically, the scanner unit 2 is arranged under the process unit 2. On the upper surface of the scanner unit 2 is attached a scanner cover 26. This scanner cover 26 is fixed at the upstream side of a bottom plate 27 of the main frame 1*a*, covering substantially the whole opening of the main frame 1*a*, and is provided with an oblong scanner hole 32 extending along the axis line of the photosensitive drum 12. The scanner unit 2 serving as an exposure unit is provided with a laser emitting element (not shown), a scanner motor 28, a polygon mirror 29, a lens 30, and a reflecting mirror 31, in which a laser beam can be passed through a glass plate 33 inserted in the oblong scanner hole 32 formed in the scanner cover 26 and emitted to the outer peripheral surface of the photosensitive drum 12 in the process unit 3. Accordingly, the electrostatic latent image is exposed on the outer peripheral surface of the photosensitive drum 12 in accordance with the image data. To the electrostatic latent image formed on the photosensitive drum 12 by the laser optical system of the scanner unit 2 in the above way, the toner is supplied through the process unit 3, performing a toner development on the electrostatic latent image.

The toner developed image based on the electrostatic latent image formed on the photosensitive drum 12 in the process unit 3 is transferred onto the sheet 50 fed to the process unit 3. After that, the sheet 50 is transported to the fixing unit 4 where the toner image transferred onto the sheet 50 is subjected to a heat fixing process by means of a pair of a heat roller 15 and a pressure roller 16. The sheet 50 on which the resultant image is formed is then discharged by the rollers 15 and 16 and stacked onto the sheet discharge tray 8 disposed at a stack position. A path along which the sheet 50 is fed from the sheet supply unit 5 to the sheet discharge tray 8 is indicated by a two-dot chain line R in FIG. 2.

Next, the detail structure of the developing chamber in the process unit 3 will be described with reference to FIGS. 3 and 4 hereinafter. FIG. 3 is a sectional side view of the process unit 3 and FIG. 4 is a sectional front view of the internal structure of the developing chamber.

Figure 4:
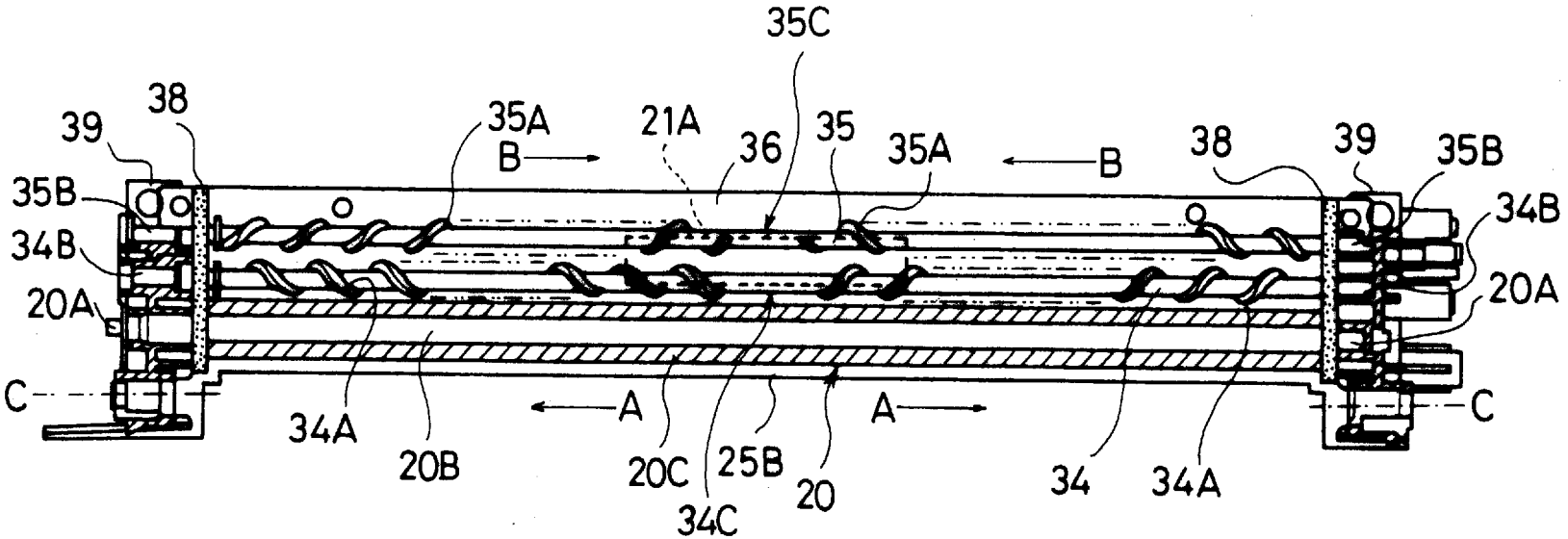
FIG. 4 is a sectional front view showing the internal construction of a developing chamber in the first embodiment.

The developing chamber D is a space surrounded by an upper seal member 37 disposed at a lower surface of an upper frame 25A of the unit frame 25, a lower frame 25B of the unit frame 25, and a pair of side seal members 38 shown in FIG. 4 formed of a sponge material, disposed at both sides inside the developing chamber D. The toner supply roller 20 is constructed of a main shaft 20B provided with shafts 20A at both ends thereof, and a roller member 20C formed of a sponge material covering the main shaft 20B in its entire length. Each of the end shafts 20A is inserted in a hole of the side seal member 38 and supported at its outer side with each of a pair of supporting plates 39 attached rotatably to the lower frame 25B.

Meanwhile, the rotating center of each supporting plate 39 is indicated by a dashed line C in FIG. 4. Each supporting plate 39 also supports rotatably the developing roller 19, so that each supporting plate 39 is biased in a clockwise direction in FIG. 3 by means of a biasing spring (not shown) to rotate clockwise about the center C, allowing the developing roller 19 to come into contact with the photosensitive drum 12. With each supporting plate 39, the toner supply roller 20, the upper and lower auger rollers 34 and 35, and the developing roller 19 are supported integrally, making it possible to easily regulate a positional relation among the above components by handling them as a unit and thus to easily conduct the maintenance thereof.

As shown in FIG. 4, further, the lower auger roller 34 in which a center portion 34C thereof is substantially correspondent to a position where the toner supply port 21A is formed (corresponding to a center portion of the toner supply port 21A), is provided with spiral teeth 34A formed spirally extending from the center portion 34C toward both ends of the auger roller 34 on the outer surface thereof. A roller shaft 34B of the auger roller 34 is supported by the supporting plates 39 at both ends as well as the toner supply roller 20. When the lower auger roller 34 is rotated clockwise in FIG. 3, accordingly, the toner supplied from the toner supply port 21A is transported successively along each spiral direction of the spiral teeth 34A above the toner supply roller 20 in both side directions indicated by A in the developing chamber D. A center portion 35C of the upper auger roller 35 is substantially correspondent to a position where the toner supply port 21A is formed (corresponding to a center portion of the toner supply port 21A). The upper auger roller 35A is provided with spiral teeth 35 formed spirally extending from both ends of the auger roller 35 to the center portion 35C. A roller shaft 35B of the auger roller 35 is supported by each support shaft 39 as well as the upper auger roller 34. When the upper auger roller 35 is rotated clockwise in FIG. 3 and the toner transported by the lower auger roller 34 in the both side direction in the developing chamber D is so increased to reach the upper auger roller 35, the toner is transported successively along the spiral direction indicated by B of the spiral teeth 35A toward the toner supply port 21A. At this time, a part of the toner is return to the toner cartridge 21 through the toner supply port 21A. In this way, the toner not used for image development is circulated as above and returned to the toner cartridge 21, so that it prevents toner from remaining in the developing chamber D for a long time. This makes it possible to supply constantly fresh toner from the toner cartridge 21. Even if the toner is not returned to the toner cartridge 21, stirring and circulating by the upper and lower auger rollers 35 and 34 makes toner smoothly flow in the developing chamber D without causing agglomeration of toner.

As mentioned above, each of the upper and lower auger rollers 35 and 34 serves to transport and circulate the toner supplied from the toner supply port 21A into the developing chamber D, above the toner supply roller 20, thereby enabling the uniform supplying of toner on all over the toner supply roller 20 without allowing the toner to remain in a limited part. As toner is transported and circulated above the toner supply roller 20 and in its both side directions by means of the upper and lower auger rollers 35 and 34, constantly fresh toner can be stuck on all over the toner supply roller 20, making it possible to supply uniformly toner to the developing roller 19 and the electrostatic latent image formed on the outer peripheral surface of the photosensitive drum 12, thereby to form for a long time the resultant image excellent in quality.

Furthermore, the forming position of the toner supply port 21A in the toner cartridge 21 (a center position of the toner supply port 21A) substantially coincides with the center positions 34C and 35C of the upper and lower auger rollers 35 and 34, so that the toner discharged through the toner supply port 21A can efficiently be transported and circulated above the toner supply roller 20 via the upper and lower auger rollers 35 and 34.

As described in detail above, the developing device in the first embodiment according to the present invention, a pair of upper and lower auger rollers 35 and 34 are disposed in the vicinity of the toner supply port 21A, the toner is allowed to transported from the toner supply port 21A toward both sides of the developing chamber D (i.e., both ends of the toner supply roller 20) through the spiral teeth 34A of the lower auger roller 34, and, the toner is transported from the both sides toward the toner supply port 21A via the spiral teeth 35A of the upper auger roller 35, thereby transporting and circulating the toner in both end directions above the toner supply roller 20, so that constantly fresh toner is circulated during a transporting and circulating of toner and thus can be stuck on all over the toner supply roller 20. This makes it possible to uniformly supply toner on the developing roller 19 and the electrostatic latent image formed on the outer surface of the photosensitive drum 12, forming for a long time the resultant image excellent in quality on the sheets 50.

As the forming position of the toner supply port 21A of the toner cartridge 21 (the center position of the toner supply port 21A) substantially coincides with the center positions 35C and 34C of the upper and lower auger members 35 and 34, it is possible to effectively supply toner supplied from the toner supply port 21A, above the toner supply roller 20, by means of the pair of upper and lower auger rollers 35 and 34.

Figure 5:
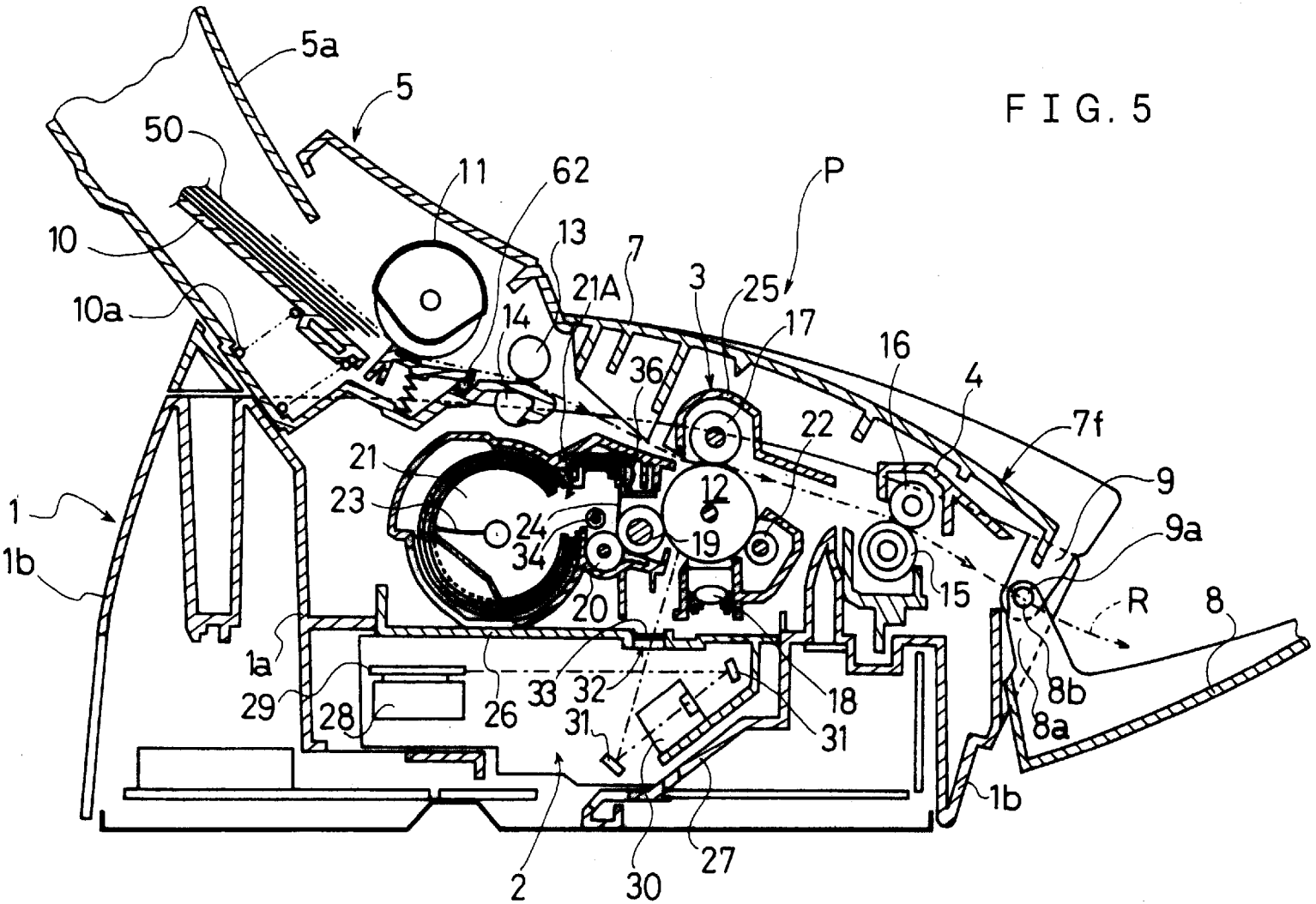
FIG. 5 is a sectional side view of a laser printer in a second embodiment according to the present invention.
Figure 6:
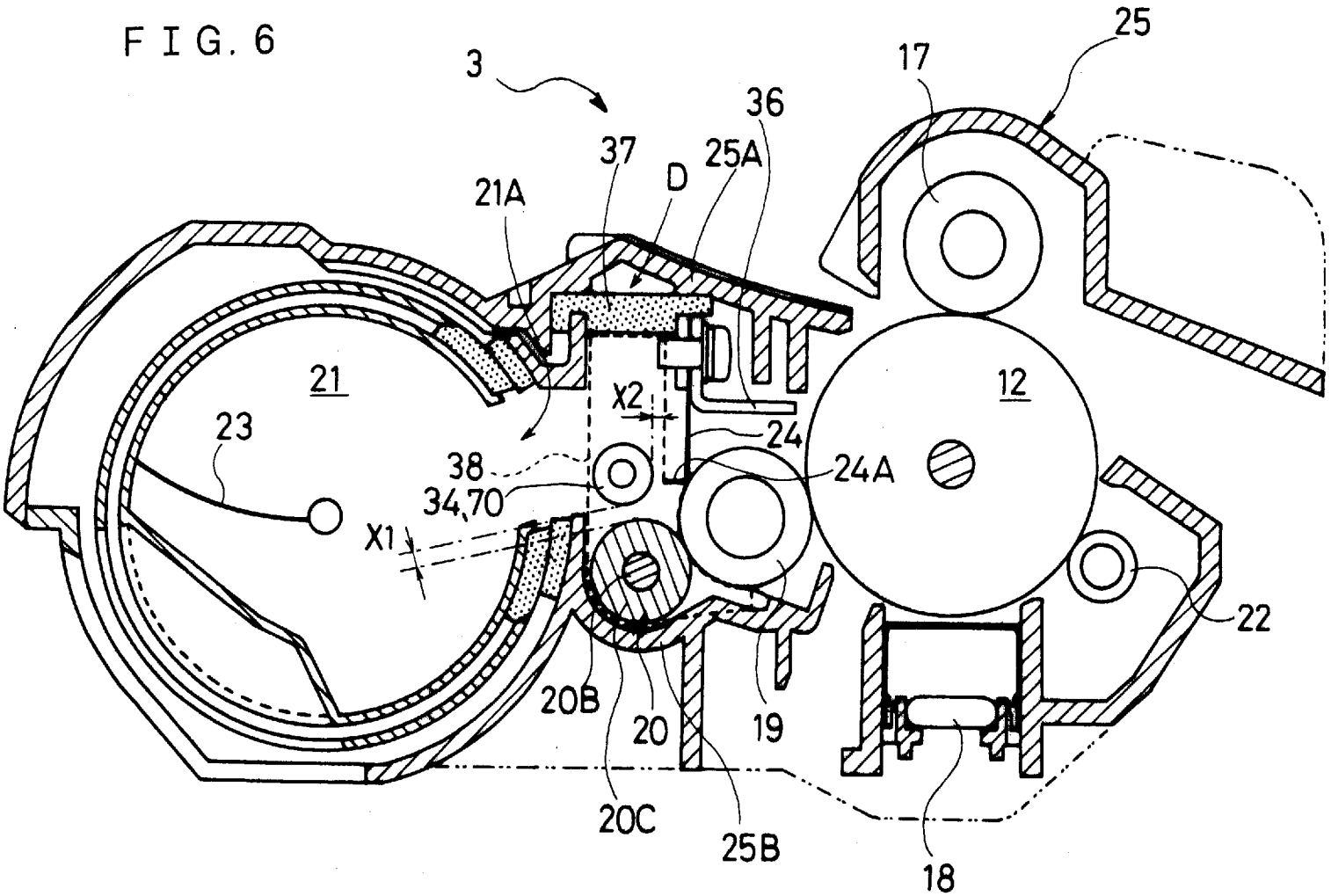
FIG. 6 a sectional side view of a process unit in the second embodiment and also the third embodiment.
Figure 7:
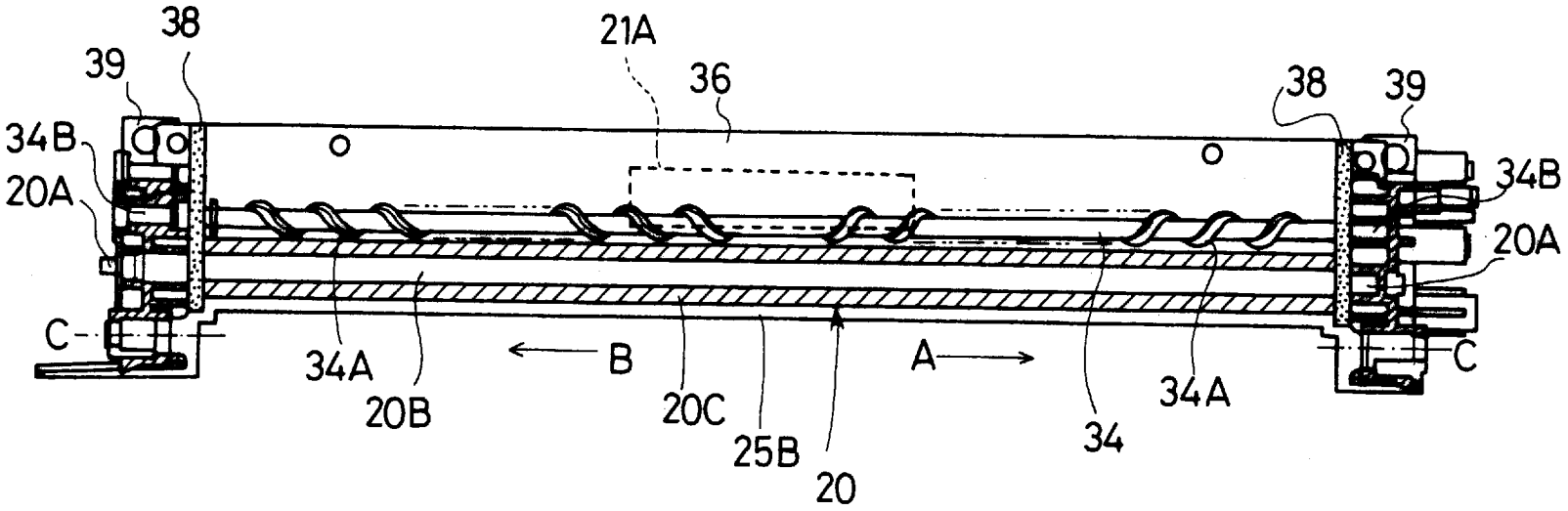
FIG. 7 is a sectional front view showing the internal construction of a developing chamber in the laser printer in the second embodiment.

Next, a second embodiment according to the present invention will be explained with reference to FIGS. 5 to 7. FIG. 5 is a sectional side view of a laser printer in the second embodiment. FIG. 6 is a sectional side view of a process unit. FIG. 7 is a sectional front view of the internal construction of the developing chamber in a developing device.

This developing device in the second embodiment, as shown in FIG. 5, has mainly the same structure as in the first embodiment and differs therefrom in that a single auger roller is provided although a pair of auger rollers are provided in the first embodiment. Those elements which are identical to those in the first embodiment are indicated by like numerals.

As shown in FIG. 7, an auger roller 34 is provided with spiral teeth 34A formed spirally on the peripheral surface of the auger roller 34 from the center position (corresponding to the center position of the toner supply port 21A) toward both ends of the auger roller 34, and a roller shaft 34B. This roller shaft 34B is supported at its both ends by the supporting plates 39 as well as the toner supply roller 20 is. At this time, a gap X1 is formed between the outer peripheral surface of the toner supply roller 20 and that of the auger roller 34 as shown in FIG. 6. The gap X1 is determined to 0.5 mm or more, preferably to 1.0 mm or more. A gap X2 is also formed between the outer peripheral surface of the auger roller 34 and the tip end of the protruding portion 24A of the blade 24. This gap X2 is determined to 0.5 mm or more, preferably to 1.0 mm or more. The relation between the gap X1 and the gap X2 will be described later.

In the developing device constructed above, all of the toner supply roller 20, the developing roller 19, and the auger roller 34 are driven to rotate in a clockwise direction. A toner supply path formed around the toner supply roller 20 and the developing roller 19 inside the developing chamber D is so formed as to pass from the toner supply port 21A upward through the gap X1 between the auger roller 34 and the toner supply roller 20 and the gap X2 between the tip end of the extruding portion 24A of the blade 24 and the auger roller 34.

Figure 9:
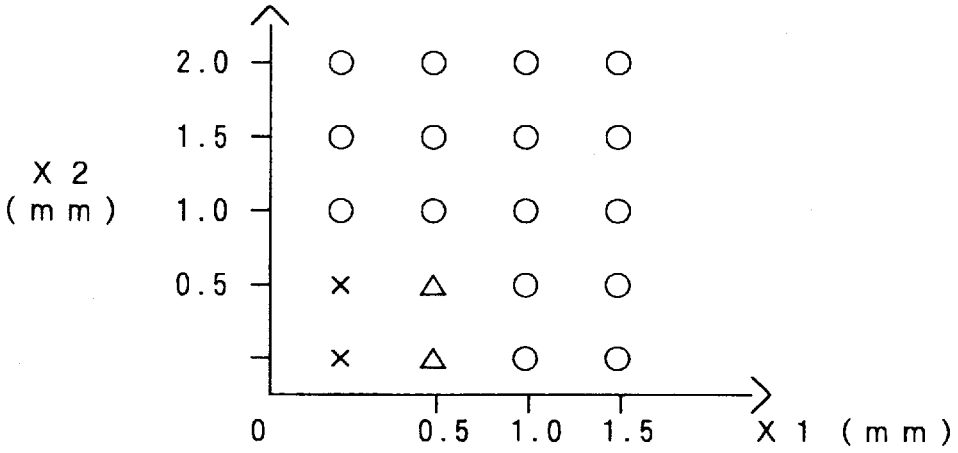
FIG. 9 is a table showing a relation between gaps X1 and X2 and the image quality of the resulting image in variously changing the gaps X1 and X2 in the second and third embodiments.
Figure 10:
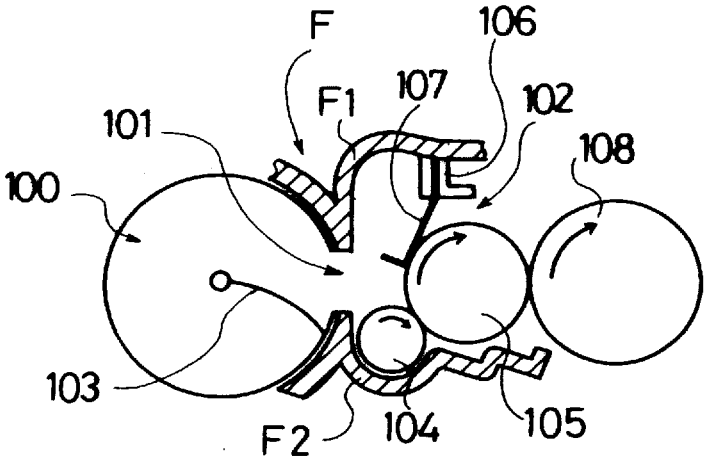
FIG. 10 is an explanatory view schematically showing a main part of a developing device in the prior art.
Figure 11:
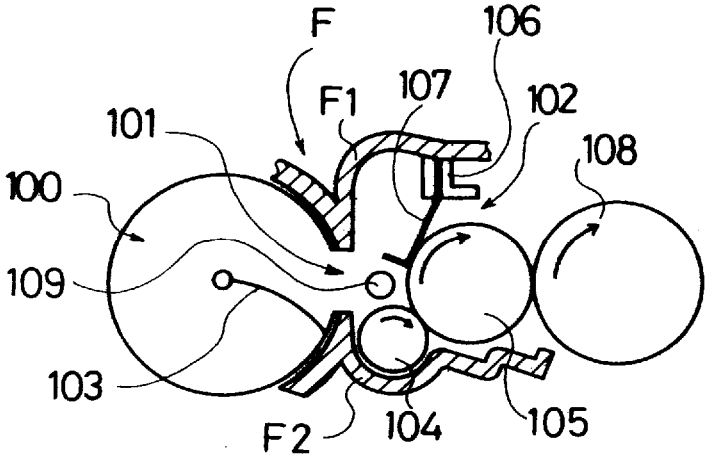
FIG. 11 is an explanatory view schematically showing a main part of another developing device provided with an auger roller in the prior art.

When the auger roller 34 is rotated clockwise in FIG. 6, the toner supplied from the toner supply port 21A is successively transported in the spiral direction along the spiral teeth 34A above the toner supply roller 20, in both side directions of the developing chamber D (indicated by arrows A and B in FIG. 9). The auger roller 34 serves to transport and circulate the toner supplied from the toner supply port 21A into the developing chamber D, above the toner supply roller 20, so that constantly fresh toner can be supplied uniformly to the toner supply roller 20 from the toner cartridge 21 without allowing the toner to remain in a limited part. As mentioned above, since the toner supply roller 20 and the developing roller 19 are rotated clockwise in FIG. 6, the toner that is not stuck on the toner supply roller 20 is moved along the route passing the gaps X1 and X2 as described above.

Figure 8:
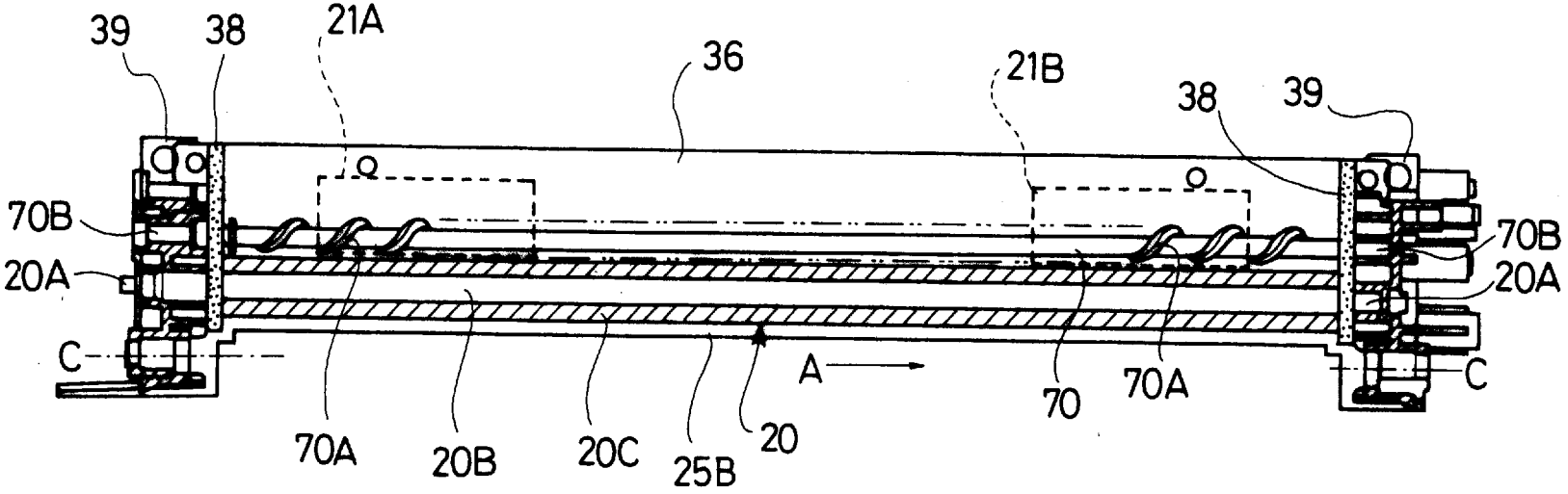
FIG. 8 is a sectional front view showing the internal construction of a developing chamber in a laser printer in a third embodiment according to the present invention.

Furthermore, a third embodiment according to the present invention will hereinafter be explained with reference to FIG. 8. FIG. 8 is a sectional front view showing the internal structure of a developing chamber of a developing device in the third embodiment. This developing device in the third embodiment has basically the same construction as that in the second embodiment, excepting that the toner cartridge 21 is provided with a toner supply port 21A formed at one end of the toner cartridge 21 and a toner suction port 21B at another end of same and the auger roller transports and circulates toner from the toner supply port 21A to the toner suction port 21B based on the positional relation between the toner supply port 21A and the toner suction port 21B. In this third embodiment, additionally, an auger roller 70 is used instead of the auger roller 34, which will be mentioned later. Accordingly, the principle object of the following explanation is in the different point from the second embodiment.

In FIG. 8, the developing device is provided with the toner supply port 21A constructed of an opening formed at one end of the toner cartridge 21 (in the left side in FIG. 8) and an opening formed in the unit case 25 so as to correspond to the left opening of the toner cartridge 21, and the toner suction port 21B positioned opposite to the toner supply port 21A (in the right side in FIG. 8), which is, similarly to the toner supply port 21A, constructed of an opening formed at another end of the toner cartridge 21 (in the right side in FIG. 8) and an opening formed in the unit case 25 so as to correspond to the right opening of the toner cartridge 21. In the vicinity of the toner supply port 21A and the toner suction port 21B is rotatably disposed an auger roller 70 for transporting and circulating the toner discharged from the toner supply port 21A toward the toner suction port 21B above the toner supply roller 20. The auger roller 70 is provided with a spiral tooth 70A formed spirally extending from one end (a left end) of the auger roller 70 to another (a right end) and a roller shaft 70B which is supported by each of supporting plates 39 in the same way as the toner supply roller 20 is. With this auger roller 70, the toner supplied from the toner supply port 21A is continuously transported in the spiral direction along the spiral tooth 70A above the toner supply roller 20 to the right side inside the developing chamber D in the direction indicated by an arrow A.

In this way, due to the toner transporting operation by the auger roller 70, the toner is circulated along the route from the toner supply port 21A, via the toner suction port 21B to the toner cartridge 21, so that the toner not used for an image development is circulated as above and returned to the toner suction port 21B. This prevents the toner from remaining a long time inside the developing chamber D, thus making it possible to supply constantly fresh toner from the toner cartridge 21.

At this time, in the developing device constructed above, the toner supply path formed around the toner supply roller 20 and the developing roller 19 in the developing chamber D is provided as a route extending from the toner supply port 21A and passing the gap X1 between the auger roller 70 and the toner supply roller 20, the gap X2 between the tip end of the protruding portion 24A of the blade 24 and the auger roller 70, and going upward, as well as in the second embodiment shown in FIG. 6. Both of the toner supply roller 20 and the developing roller 19 are driven to rotate clockwise in FIG. 6, thereby allowing the toner not stuck on the toner supply roller 20 to move along the route passing the gap X1 and the gap X2 as mentioned above. This structure is the same as in the second embodiment.

Next, explained is the influence by each variation of the gap X1 and the gap X2 on the resultant image, in the above second and third embodiments, when an image informing operation is performed with each developing device in the second and third embodiments, while changing the gap X2 formed between the protruding portion 24A of the blade 24 and the auger roller 34 or 70 and the gap X1 formed between the outer peripheral surface of the toner supply roller 20 and the outer peripheral surface of the auger roller 34 or 70, referring to FIG. 9.

FIG. 9 is a table showing the relation between the gap X1 and the gap X2 and the quality of the resultant image when those gaps X1 and X2 are changed variously, where the horizontal axis indicates the gap X1 (unit: mm) and the vertical axis indicates the gap X2 (unit: mm) respectively. In the table, "○" means that the resultant image with high quality was obtained even after an image forming operation was performed on 10000 or more sheets, "Δ" means that the resultant image deteriorated in quality after the image forming operation on several thousand of sheets, and "x" means that auger marks by the auger roller 34 or 70 formed on the sheet at an early stage of the image forming operation.

As clearly from FIG. 9, auger marks generated when the gap X1 was 0.5 mm or less, the deterioration in image quality of the resultant image occurred when the gap X1 was about 0.5 mm; however, it is found that the good quality of the resultant image could be obtained even after the image forming operation has been performed on 10000 or more sheets when the gap X1 was 0.5 mm or more. It is found that auger marks generated when the gap X2 was 0.5 mm or less, or about 0.5 mm, and the resultant image good in quality could be obtained even after the image forming operation has been made on 10000 or more sheets when the gap X2 was 0.5 mm or more.

Consequently, if both the gaps X1 and X2 are determined to 0.5 mm or more, it could maintain the good quality of resultant image even after the image forming operation has been conducted on 10000 or more sheets, and preferably if both the gaps X1 and X2 are determined to 1.0 mm or more, it could maintain the excellent quality of resultant image sufficiently even after the image forming operation has been conducted on 10000 or more sheets.

As described above, in the developing devices in the second and third embodiments, the gap X1 formed between the protruding portion 24A of the blade 24 and the outer peripheral surface of the auger roller 34 or 70 and the gap X1 formed between the outer peripheral surface of the toner supply roller 20 and the outer peripheral surface of the auger roller 34 or 70 both determined to 0.5 mm or more, so that the toner supply path formed around the toner supply roller 20 and the developing roller 19, including the gaps X1 and X2, can be prevented from being clogged with toner. Accordingly, in combination of the transporting and circulating operation by means of the auger roller 34 or 70, it is possible to maintain the good flow of toner in the toner supply path and thus to supply smoothly toner from the toner supply roller to the developing roller. This can form for a long time the resultant image excellent in quality.

If the gaps X1 and X2 are determined to 1.0 mm or more, furthermore, it can surely prevent the toner supply path formed around the toner supply roller 20 and the developing roller 19, including the gaps X1 and X2, from being clogged with toner.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A developing device for use in an image forming apparatus for performing image formation through an electrophotographic process, comprising a developing roller arranged opposite to a photosensitive drum, for supplying toner to an electrostatic latent image formed on the photosensitive drum thereby to develop the image, a supply roller arranged opposite to the developing roller and for supplying toner to the developing roller, the device comprising:

a toner supply port through which toner is supplied to a developing chamber provided therein with said developing roller and said supply roller; and a pair of first and second auger members arranged in the vicinity of said toner supply port, for transporting and circulating toner from the toner supply port and supplying the toner to the supply roller, wherein said toner supply port is formed at a center position of the developing chamber, said first auger member transports toner from a position corresponding to the toner supply port toward both ends of the supply roller and said second auger member transports toner from both ends toward the center position corresponding to the toner supply port, wherein a position where said toner supply port is formed corresponds substantially to each center portion of said first and second auger members, and the first auger member is disposed at a lower position than the second auger member.

2. A developing device for use in an image forming apparatus according to claim 1, wherein said first auger member is provided with a spiral tooth extending from a center position of the first auger member toward both ends thereof, and said second auger member is provided with a spiral tooth extending from both ends of the second auger member toward a center position thereof.

3. A developing device for use in an image forming apparatus for performing image formation through an electrophotographic process, comprising a developing roller arranged opposite to a photosensitive drum, for supplying toner to an electrostatic latent image formed on the photosensitive drum thereby to develop the image, a supply roller arranged opposite to the developing roller and for supplying toner to the developing roller, an L-shaped blade member provided with a contact portion being in contact with a surface of the developing roller and a protruding portion formed protruding outward from the contact portion, the protruding portion having a proximal end proximate to the contact portion and a distal end distant from the contact portion, the blade member for regulating a thickness of a toner layer on the developing roller, the device comprising:

a toner supply port through which toner is supplied to a developing chamber provided therein with said developing roller, said supply roller, and the blade member; and an auger member disposed in the vicinity of the toner supply port, for transporting and circulating toner from the toner supply port and supplying the toner to the supply roller;

wherein a first gap formed between the distal end of the protruding portion of the blade member and an outer peripheral surface of the auger member and a second gap formed between an outer peripheral surface of the supply roller and the outer peripheral surface of the auger member are determined to be 0.5 mm or more.

4. A developing device for use in an image forming apparatus according to claim 3, wherein said first and second gaps are determined to 1.0 mm or more.

5. A developing device for use in an image forming apparatus according to claim 3, wherein said toner supply port is formed at a center position of the developing chamber, said auger member transports toner from a position corresponding to the toner supply port toward both ends of the supply roller.

6. A developing device for use in an image forming apparatus according to claim 5, wherein said auger member is provided with a spiral tooth extending from a center position of the auger member toward both ends thereof.

7. A developing device for use in an image forming apparatus for performing image formation through an electrophotographic process, comprising a developing roller arranged opposite to a photosensitive drum, for supplying toner to an electrostatic latent image formed on the photosensitive drum thereby to develop the image, a supply roller arranged opposite to the developing roller and for supplying toner to the developing roller, an L-shaped blade member provided with a contact portion being in contact with a surface of the developing roller and a protruding portion formed protruding outward from the contact portion, for regulating a thickness of a toner layer on the developing roller, the device comprising:

a toner supply port and a toner suction port respectively formed in both sides of a developing chamber provided therein with the developing roller, the supply roller, and the blade member; and an auger member disposed in the vicinity of the toner supply port and the toner suction port, for transporting and circulating toner from the toner supply port toward the toner suction port and supplying the toner to the supply roller;

wherein a first gap formed between the protruding portion of the blade member and an outer peripheral surface of the auger member and a second gap formed between an outer peripheral surface of the supply roller and the outer peripheral surface of the auger member are determined to 0.5 mm or more.

8. A developing device for use in an image forming apparatus according to claim 7, wherein said auger member is provided with a spiral tooth extending from one end of the auger member to another.

9. A developing device for use in an image forming apparatus according to claim 7, wherein said developing roller, said supply roller, and said auger member are driven to rotate in the same rotating direction.

10. A developing device for use in an image forming apparatus for performing image formation through an electrophotographic process, comprising a developing roller arranged opposite to a photosensitive drum, for supplying toner to an electrostatic latent image formed on the photosensitive drum thereby to develop the image, a supply roller arranged opposite to the developing roller and for supplying toner to the developing roller, an L-shaped blade member provided with a contact portion being in contact with a surface of the developing roller and a protruding portion formed protruding outward from the contact portion, for regulating a thickness of a toner layer on the developing roller, the device comprising:

a toner supply port through which toner is supplied to a developing chamber provided therein with the developing roller, the supply roller, and the blade member; and an auger member disposed in the vicinity of the toner supply port, for transporting and circulating toner from the toner supply port and supplying the toner to the supply roller;

wherein at least one of a first gap formed between the protruding portion of the blade member and an outer peripheral surface of the auger member and a second gap formed between an outer peripheral surface of the supply roller and the outer peripheral surface of the auger member is determined to 1.0 mm or more.

* * * * *